United States Patent [19]

Reckson

[11] 4,084,360

[45] Apr. 18, 1978

[54] COMBINATION SPLINE GROOVE

[76] Inventor: Harry Reckson, 2750 NE. 183 St., Apt. 2610, North Miami Beach, Fla. 33161

[21] Appl. No.: 693,797

[22] Filed: Jun. 8, 1976

[51] Int. Cl.[2] ..... E04B 1/343; E06B 9/24; A47H 13/00

[52] U.S. Cl. ..... 52/63; 52/586; 160/371; 160/392

[58] Field of Search ..... 52/63, 731, 586; 160/392, 394, 395, 371

[56] References Cited

U.S. PATENT DOCUMENTS

| | | | |
|---|---|---|---|
| 2,548,163 | 4/1951 | Kaufmann | 160/371 |
| 2,835,325 | 5/1958 | Gilbert et al. | 160/395 |
| 2,837,153 | 6/1958 | Brown et al. | 52/63 |
| 2,897,889 | 8/1959 | Kessler | 160/392 |
| 3,143,165 | 8/1964 | Lewis et al. | 160/371 |
| 3,696,857 | 10/1972 | Le Tarte | 160/371 |
| 3,805,873 | 4/1974 | Bloomfield et al. | 160/392 |
| 3,879,894 | 4/1975 | Anderson et al. | 160/395 |

*Primary Examiner*—James L. Ridgill, Jr.
*Attorney, Agent, or Firm*—Clarence A. O'Brien; Harvey B. Jacobson

[57] ABSTRACT

An extruded building device having a spline groove of unique shape for reception of either a flat or a round spline therein for retention of fiberglass or other type of screen material firmly retained within the spline groove. The structure is particularly useful with screen door and patio screen sections as used to prevent flies and other insects from entering a building.

12 Claims, 11 Drawing Figures

COMBINATION SPLINE GROOVE

BACKGROUND OF THE INVENTION

1. Field of the Invention

This invention relates to structural components usable in building structures such as screen doors and patio screen sections for retaining screen material positively within spline grooves provided in said structures.

2. Description of the Prior Art

A common problem with known type construction sections for screen doors, patio screen structures, and the like, is that a number of such sections must be provided for the overall device and each part specifically provided therefor. This entails a large inventory on the part of the manufacturer and assembler of the devices. Large inventories involve extra expense and extra storage at distribution facilities.

Another common problem with known devices is that they can only use one type of spline in conjunction with the screen material to be retained within the spline groove section. That is, some are specifically designed for round spline type retention members while others are designed for flat type, and still others designed for various unusual shapes and modifications.

SUMMARY OF THE INVENTION

An object of the present invention is to provide a building structure component which is particularly adapted for retaining screen material in a spline groove provided therein. The spline groove is of such configuration that the retention means for the screen material may be either a flat or a round spline strip.

Another object of this invention is to provide a building structure component which is usable in making screen doors, patio screen sections, and the like, and has a universal application to these and many other finished structures. This will substantially reduce the necessary inventory for the structural components of such devices.

A further object of this invention is to provide a building section of extruded aluminum which has a combination spline groove provided therein for reception of various configurations of retention splines therein. The unique configuration is such that a number of different combinations may be created with the one simple building structure.

The building component of this invention is preferably extruded from aluminum material and has a combination spline groove provided along one edge thereof for reception of screen material which is retained therein by numerous type spline devices. Primarily, either flat and/or round type splines are used, but other configurations also are envisioned. The basic spline groove of this invention may be used with many different building structures such as screen doors, patio screen enclosures, portable backyard screen enclosures, and many other applications of this nature.

By eliminating a number of structural components commonly necessary to build such structures, a great saving in time, cost of materials, storage and inventory problems, and other related factors are achieved.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
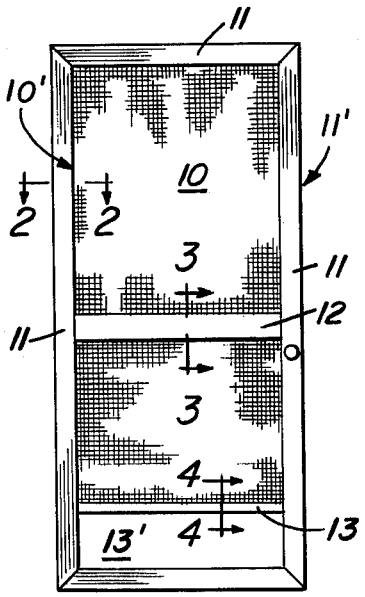
FIG. 1 is a front elevational view of a screen door incorporating the extruded building structure with combination spline groove therein as disclosed by this invention.

Looking at FIG. 1 of the drawings, the spline groove structural component of this invention is shown as in combination with a screen door. Normally, screen doors and other building structures for supporting and retaining screen material for patios, sunrooms, backyard enclosures, and other related devices employ screen material mounted upon a structural and semi-rigid framework. Normally, spline grooves are provided along the side edges of such structural components in order to positively retain the screen material in proper position on the stucture. Normally, the spline grooves are also so designed that if the screen material becomes damaged or full of holes which obviously defeats the purpose of the screening, new screen material may be fairly quickly and easily replaced.

Figure 2:
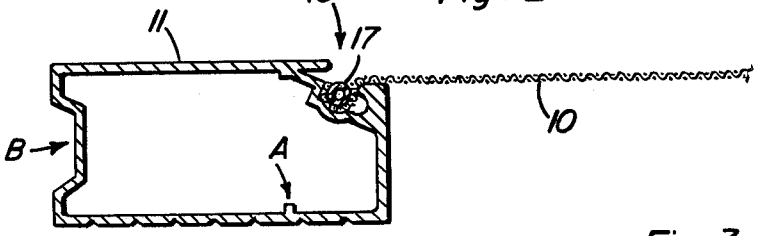
FIG. 2 is a cross-sectional view of the door stile taken generally along line 2—2 of FIG. 1.

The screen door shown in FIG. 1 has screening material 10 supported thereon of either fiberglass or other screen material and is normally provided with door stiles 11, a door pushbar 12, a kick plate bar 13 and panel 13'. The door stiles 11, may best be seen in cross section in FIG. 2, wherein it may be seen that said stiles are basically a rectangular tube provided with appropriate strengthening projections A and recesses B therein for structural rigidity as is common in such building components, together with the screening material being retained within the combination spline groove of this invention by a round spline strip 17.

Figure 3:
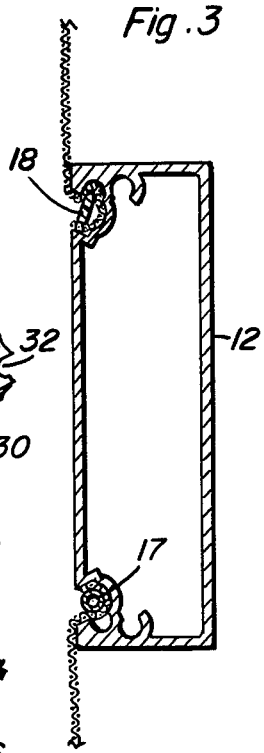
FIG. 3 is a cross-sectional view of the door pushbar taken generally along line 3—3 of FIG. 1.

FIG. 3 shows the pushbar for the screen door with this pushbar 12 having a spline groove provided along each of two of the edges thereof for reception of the screening material. The lower spline groove of this Figure has a round spline strip 17 which may be formed of vinyle as retainer therein while the upper spline groove utilizes a flat spline strip 18.

Figure 4:
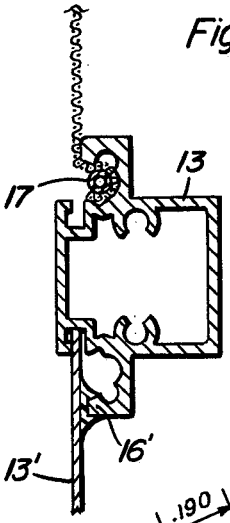
FIG. 4 is a cross-sectional view of the kick plate for the screen door as taken generally along line 4—4 of FIG. 1.
Figure 5:
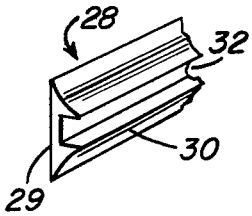
FIG. 5 is a perspective view, in part, of the kick plate spline as used in combination with the device of this invention.

FIG. 4 shows the kick plate bar 13 having double spline groove portions provided along two of the sides or edges thereof. However, in this particular application the lower spline groove is used in conjunction with a spline strip 28 of vinyl material and the like, of special configuration, as best seen in FIG. 5. This member 28 is provided with a flat side 29 for engagement with the main kick plate panel 13' while the other side of said vinyl strip is tapered at 30 to a center recess portion 32 which will engage with the edge 16' of the spline groove structure.

Figure 6:
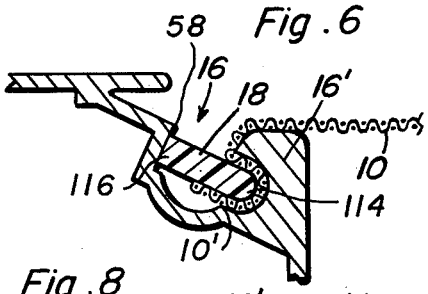
FIG. 6 is an enlarged view, in cross section, of the extruded spline groove of this invention as used with a flat spline strip.
Figure 7:
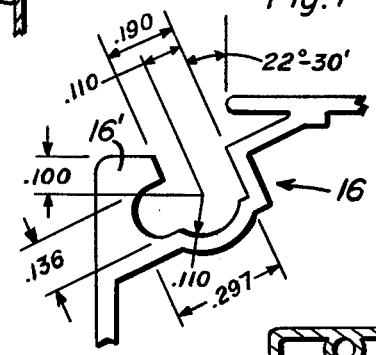
FIG. 7 is an enlarged cross-sectional view of the extruded spline groove formed in the structural member showing the preferred dimensions thereof.

Looking at FIG. 4 one can easily visualize how the new combination spline groove 16 of this invention may be utilized to hold the screening material and associated building structural components in assembled relation with the single specific configuration as disclosed and best seen in FIGS. 6 and 7.

FIG. 7 shows the exact dimensions of this combination spline groove structure which has been found to be extremely useful with a number of different building components and building structures. The dimensions will not be recited herein because the Figure is of large enough scale and the dimensions accurately shown thereon that recitation herein would appear to be superfluous. However, these dimensions are quite critical and should be followed quite closely by the users of this invention.

FIG. 6 shows the combination spline groove as already described in enlarged cross section and as holding a piece of screen material 10 by using a flat spline strip 18. The manner in which the flat spline strip 18 engages with the inside portions of the spline groove together with the screening material can be clearly seen in this Figure.

Figure 8:
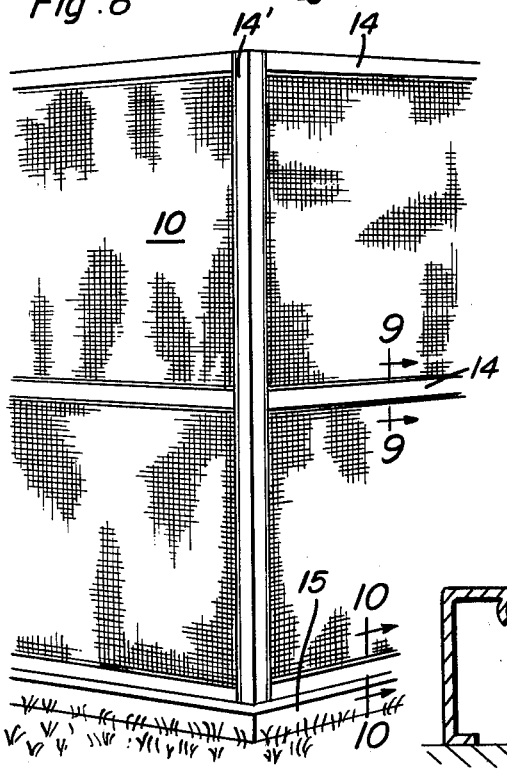
FIG. 8 is a view, in part, of a screen enclosure structure for a patio room or the like incorporating the features of this invention.
Figure 9:
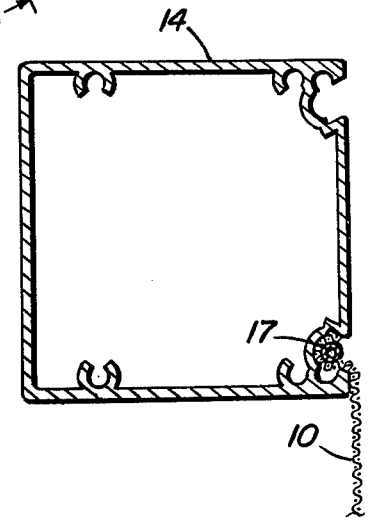
FIG. 9 is a cross-sectional view taken generally along line 9—9 of FIG. 8.
Figure 10:
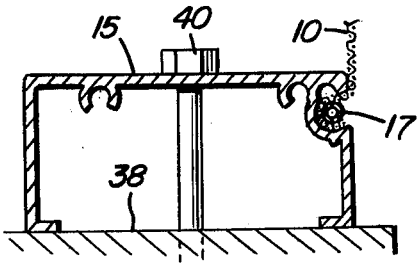
FIG. 10 is a cross-sectional view taken generally along line 10—10 of FIG. 8.

While the device already described has particular use with screen door construction, it also is very usable in many other type of enclosures which involve screening material. The second embodiment or application of this device is shown in FIGS. 8, 9 and 10. This shows the construction of a roomtype screen enclosure for patios, backyard enclosures, swimming pools, and the like. End stiles of construction similar to that of member 14 normally will be provided. The bars or structural components 14 are extruded normally from aluminum or similar easily extruded material and provided along two edges thereof with the spline groove 16 of this invention as best seen in FIG. 9. FIG. 9 shows the screen material 10 being retained within one of said spline grooves 16 by a round spline strip 17.

FIG. 10 shows the base component 15 which is normally attached to some type of foundation, in this example, a concrete base or patio together with an appropriate anchoring bolt or stud 40 as shown. With base component 15, normally only a single spline groove structure need be provided. Again, the screening material 10 is shown as anchored by means of a round vinyl strip 17, but obviously the flat spline strip 18 may be used equally as well. Corner stiles 14' also are constructed with similar spline grooves therein.

Figure 11:
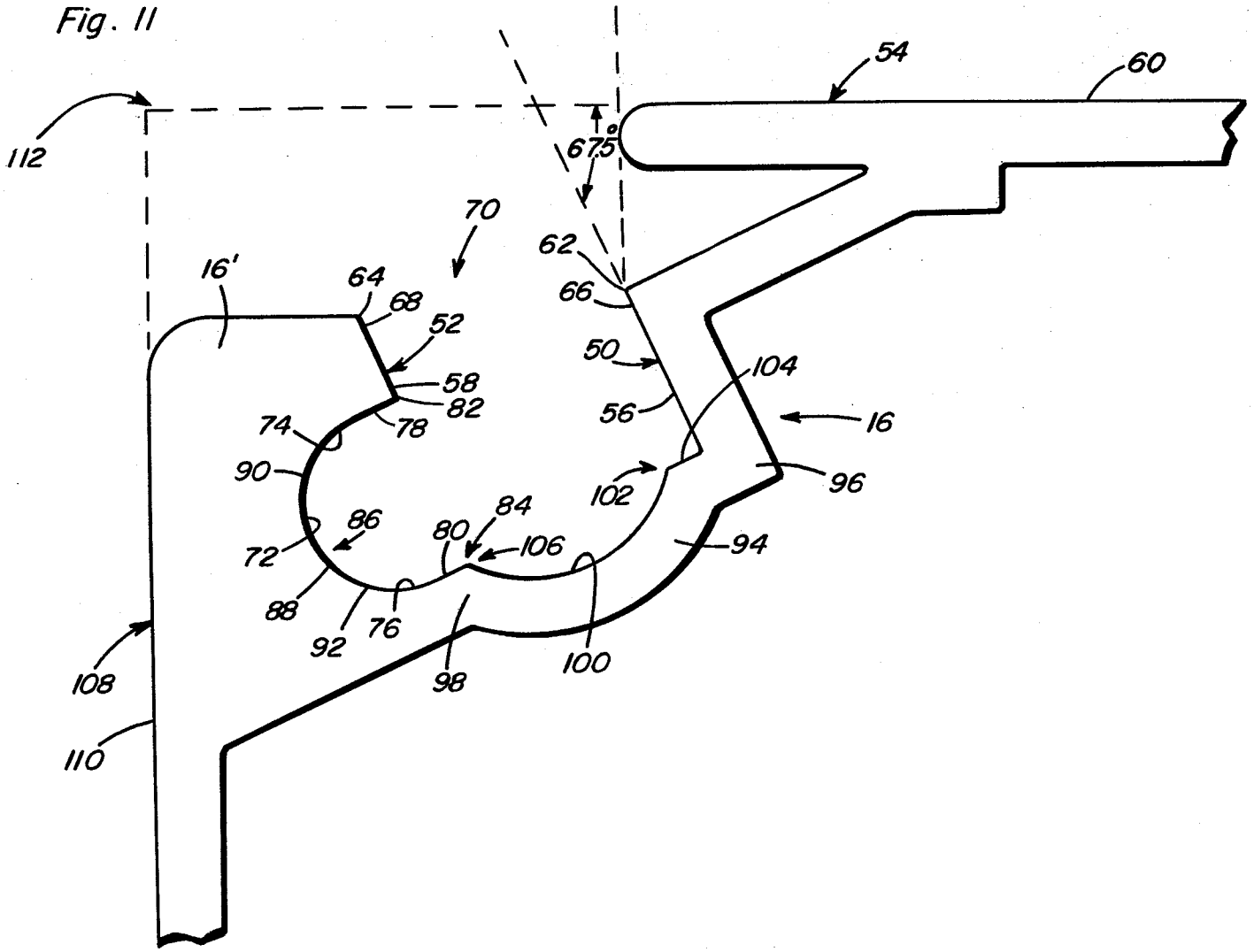
FIG. 11 is an enlarged cross-sectional view of the extruded spline groove formed in the structural member.

Referring now to FIG. 11, the spline groove 16 of the present invention is seen to be formed in an elongated structural body member such as the door stile 11 of the elements 13, 14, 14', such structural elements being illustrated in FIGS. 1–10. The door stile 11 forms a portion of a frame 11' over which the screen material 10 is retained, edge portions 10' of the screen material 10 being held within the spline groove 16 formed in the door stile 11 by means of a spline strip, such as the strips 17 and 18. The spline groove 16 essentially comprises spaced first and second wall members 50 and 52 formed in a planar wall 54 of the door stile 11, planar inner wall surfaces 56 and 58 of the wall members 50 and 52 being parallel and being disposed at an angle to an outer planar surface 60 of the planar wall 54, spaced parallel edges 62 and 64 of outer ends 66 and 68 of the wall members 50 and 52 defining an elongated opening 70 therein, the second wall member 52 having a recess 72 formed longitudinally therein, the recess 72 being bounded by two spaced wall surfaces 74 and 76. The planes of the wall surfaces 74 and 76 near outer portions 78 and 80 thereof are parallel and perpendicularly intersect the plane of the inner wall surface 58 of the second wall member 52 to form first and second lateral edges 82 and 84, the recess 72 further being bounded at innermost portions 86 thereof by an arcuate wall surface 88 formed essentially by inwardly curving inner portions 90 and 92 of the two spaced wall surfaces 74 and 76. A recessed wall member 94 joins to inner ends 96 and 98 of the first and second wall members 50 and 52, the recessed wall member 94 having an arcuate recess 100 formed longitudinally therein. The arcuate recess 100 is bounded along a first lateral edge 102 thereof by a planar wall surface 104 of the recessed wall member 94, the plane of the wall surface 104 being perpendicular to the plane of the inner wall surface 56 of the first wall member 50. A second lateral edge 106 of the arcuate recess 100 is substantially coincidental with the second lateral edge 84 of the recess 72 formed in the second wall member 52. The first and second wall members 50 and 52 and the recessed wall member 94 therefore define the spline groove 16 in the door stile 11, the spline groove 16 being capable of receiving into retaining relation with the edge portions 10' of the screening material 10 spline strips 17 and 18 of varying axial cross-sectional configuration. It is to be noted that the center of curvature of the arcuate recess 100 formed in the recessed wall member 94 lies on a line parallel to the parallel surfaces 56 and 58 of the first and second wall members 50 and 52. It is to be further noted that the line vertex of the dihedral angle defined by radial planes extending respectively through the first and second lateral edges 102 and 106 of the arcuate recess 100 formed in the recessed wall member 94 and the center of the circle of which the curved portion of the arcuate recess 100 forms an arc lies along a line parallel to the planar surfaces 56 and 58 of the first and second wall members 50 and 52. The line vertex of the dihedral angle defined by radial planes extending through two spaced points lying on the arcuate wall surface 88 of the second wall member 52 and the center of the circle of which the curved portion of the arcuate recess 100 forms an arc, the two spaced points and the center being coplanar, lies along a line parallel to the planar surface portions of the two spaced wall surfaces 74 and 76 bounding the recess 72 in the second wall member 52. The angle formed by the planar inner wall surface 56 of the first wall member 50 with the outer planar surface 60 of the planar wall is preferably 67.5°. The door stile 11 can be seen to have a second planar well 108 being perpendicular to the plane of the outer planar surface 60 of the first-mentioned planar wall 54, the spline groove 16 being formed in the door stile 11 in proximity to an idealized intersection 112 of planar extensions of the surfaces 60 and 110 of the planar walls 54 and 108. The recess 72 formed in the second wall member 52 is seen to lie nearer to the second planar wall 108 than to the first-mentioned planar wall 54. The planes of the parallel planar portions of the wall surfaces 74 and 76 bounding the recess 72 formed in the second wall member 52 intersect the plane of the outer surface 110 of the second planar wall 108 at a preferred angle of 67.5°. It can further be seen that the door stile 11 is of substantially rectangular shape in cross section, the spline groove 16 being provided along at least one of the longitudinal edges thereof. The round spline strip 72 is seen to be preferably formed with a circular axial cross-sectional configuration, the flat spline strip 18 having a substantially rectangular axial cross-sectional configuration. The flat spline strip 18 is further seen to be preferably formed with an arcuate longitudinal edge portion 114 and a flat edge portion 116 on opposite faces thereof, the arcuate edge portion 114 fitting within the recess 72 formed in the second wall member 52, the flat edge portion 116 fitting against the planar inner wall surface 56 of the first wall member 50, as clearly seen in FIG. 6.

From the above description of this device, one can readily visualize how useful this combination spline groove structure can be when provided with the basic structural components for screen doors, patio enclosures, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an elongated structural body member (11 inter alia) such as a door stile (11) or window stile, which body member (11) forms at least a portion of a frame (11') over which a screening material (10) is retained, edge portions (10') of the screening material (10) being held within a spline groove (16) formed in the body member (11) by means of a spline strip (17, 18), the improvement comprising:

spaced first and second wall members (50, 52) formed in a planar wall (54) of the elongated body member (11), planar inner wall surfaces (56, 58) of the wall member (50, 52) being parallel and being disposed at an angle to an outer planar surface (60) of the planar wall (54), spaced parallel edges (62, 64) of outer ends (66, 68) of the wall members (50, 52) defining an elongated opening (70) therein, the second wall member (52) having a recess (72) formed longitudinally therein, the recess (72) being bounded by two spaced wall surfaces (74, 76), the planes of said wall surfaces (74, 76) near outer portions (78, 80) thereof being parallel and perpendicularly intersecting the plane of the inner wall surface (58) of the second wall member (52) to form first and second lateral edges (82, 84), the recess (72) further being bounded at innermost portions (86) thereof by an arcuate wall surface (88) formed essentially by inwardly curving inner portions (90, 92) of the two spaced wall surfaces (74, 76);

a recessed wall member (94) joined to inner ends (96, 98) of the first and second wall members (50, 52), the recessed wall member (94) having an arcuate recess (100) formed longitudinally therein, the arcuate recess (100) being bounded along a first lateral edge (102) thereof by a planar wall surface (104) of the recessed wall member (94), the plane of the wall surface (104) being perpendicular to the plane of the inner wall surface (56) of the first wall member (50), a second lateral edge (106) of the arcuate recess (100) being substantially coincidental with the second lateral edge (84) of the recess (72) formed in the second wall member (52), the first and second wall members (50, 52) and the recessed wall member (94) defining the spline groove (16) in the elongated body member (11), the spline groove (16) being capable of receiving into retaining relation with the edge portions (10') of the screening material (10) spline strips (17, 18) of varying axial cross-sectional configuration.

2. The structure of claim 1 wherein the center of curvature of the arcuate recess (100) formed in the recessed wall member (94) lies on a line parallel to the planar surfaces (56, 58) of the first and second wall members (50, 52).

3. The structure of claim 1 wherein the vertex of the dihedral angle defined by radial planes extending respectively through the first and second lateral edges (102, 106) of the arcuate recess (100) formed in the recessed wall member (94) and the center of the circle of which the curved portion of the arcuate recess (100) forms an arc lies along a line parallel to the planar surfaces (56, 58) of the first and second wall members (50, 52).

4. The structure of claim 1 wherein the line vertex of the dihedral angle defined by radial planes extending through two spaced points lying on the arcuate wall surface (88) of the second wall member (52) and the center of the circle of which the curved portion of the arcuate recess (100) forms an arc, the two spaced points and the center being coplanar, lies along a line parallel to the planar surface portions of the two spaced wall surfaces (74, 76) bounding the recess (72) in the second wall member (52).

5. The structure of claim 1 wherein the angle formed by the planar inner wall surface (56) of the first wall member (50) with the outer planar surface (60) of the planar wall (54) is 67.5°.

6. The structure of claim 1 wherein the elongated body member (11) is of substantially rectangular shape in cross section, and the spline groove (16) is provided along at least one of the longitudinal edges thereof.

7. The structure of claim 1 wherein the spline strip (17) has a circular axial cross-sectional configuration.

8. The structure of claim 1 wherein the spline strip (18) has a substantially rectangular axial cross-sectional configuration.

9. The structure of claim 8 wherein the spline strip (18) has an arcuate longitudinal edge portion (114) and a flat edge portion (116) on opposite faces thereof, the arcuate edge portion (114) fitting within the recess (72) formed in the second wall member (52) and the flat edge portion (116) fitting against the planar inner wall surface (56) of the first wall member (50).

10. The structure of claim 1 wherein the alongated body member (11) has a second planar wall (108), the plane of an outer surface (110) of the second planar wall (108) being perpendicular to the plane of the outer planar surface (60) of the first-mentioned planar wall (54), the spline groove (16) being formed in the elongated body member (11) in proximity to an idealized intersection (112) of planar extensions of the surfaces (60, 110) of the planar walls (54, 108).

11. The structure of claim 10 wherein the recess (72) formed in the second wall member (52) lies nearer to the second planar wall (108) than to the first-mentioned planar wall (54).

12. The structures of claim 10 wherein the planes of the parallel planar portions of the wall surfaces (74, 76) bounding the recess (72) formed in the second wall member (52) intersect the plane of the outer surface (110) of the second planar wall (108) at an angle of 67.5°.

* * * * *